US007803027B2

(12) United States Patent
Detweiler

(10) Patent No.: US 7,803,027 B2
(45) Date of Patent: Sep. 28, 2010

(54) WATERCRAFT PADDLE PROPULSION SYSTEM

(76) Inventor: Henry Detweiler, 1090 Graber Pl., Sarasota, FL (US) 34237

( * ) Notice: Subject to any disclaimer, the term of this patent is extended or adjusted under 35 U.S.C. 154(b) by 108 days.

(21) Appl. No.: 12/038,694

(22) Filed: Feb. 27, 2008

(65) Prior Publication Data

US 2009/0215339 A1 Aug. 27, 2009

(51) Int. Cl.
*B63H 1/04* (2006.01)

(52) U.S. Cl. ..... 440/94

(58) Field of Classification Search ..... 440/6, 440/13, 21, 90, 94, 101
See application file for complete search history.

(56) References Cited

U.S. PATENT DOCUMENTS 659,858 A * 10/1900 Palmer ..... 440/14
2,875,723 A * 3/1959 Moore ..... 440/20
3,110,283 A * 11/1963 Warner ..... 440/15
3,190,255 A * 6/1965 Olson ..... 440/90
4,490,119 A * 12/1984 Young ..... 440/14
4,913,669 A * 4/1990 Young ..... 440/14
6,193,466 B1 * 2/2001 Earl ..... 416/129
6,814,636 B2 * 11/2004 Nolen ..... 440/90
6,997,765 B1 * 2/2006 McGuinness ..... 440/14

* cited by examiner

*Primary Examiner*—Daniel V Venne
(74) *Attorney, Agent, or Firm*—Michael I Kroll

(57) ABSTRACT

A watercraft propulsion device having a plurality of cooperating paddles driven by levers in a sweeping motion while cooperating with a peddle gear and electric motor in order to produce a reciprocating back and forth paddle motion capable of driving the watercraft through water densely populated with obstructive matter such as grass, Lilly pads, logs and other debris with ease. Additionally the pedal gear of the present invention allows for the paddles to be lifted while being brought towards the watercraft and then the paddle is brought downward and away from the vessel to push the device forward. Finally a speed throttle arm is mounted to the device to control the speed at which the paddles reciprocate and to control the direction that force is applied at the stern of the watercraft.

5 Claims, 11 Drawing Sheets

WATERCRAFT PADDLE PROPULSION SYSTEM

BACKGROUND OF THE INVENTION

1. Field of the Invention

The present invention relates generally to marine vessels and, more specifically, to a nautical propulsion device comprising a plurality of cooperating paddles driven by levers in a sweeping motion while cooperating with a peddle gear and electric motor in order to produce a reciprocating back and forth paddle motion capable of driving a vessel through water densely populated with obstructive matter such as grass, Lilly pads, logs and other debris with ease. Comprising the paddles main assembly are two pivotally mounted paddles having lever arms attached to the non submerged distal ends of sad paddles so that when a peddle gear is driven a plurality of linkages cooperate to produce the opposed back and forth motion of the operating paddles. Additionally the pedal gear of the present invention allows for the paddles to be lifted while being brought towards the vessel wherethen said paddle is brought downward and away from the vessel to push the device forward. Finally a speed throttle is mounted to the device to control the speed at which the paddles reciprocate and control the directions that force is applied in to the back of a vessel.

2. Description of the Prior Art

While there are other paddle based propulsion systems, they are not suitable for the purposes of the present invention, hereinafter described.

SUMMARY OF THE PRESENT INVENTION

A primary object of the present invention is to provide a propulsion method for a vessel whereby it can easily transverse shallow water with a high concentration of grass, Lilly pads, logs and debris with ease utilizing a pair of pivotally and horizontally, transgressing paddles.

Another object of the present invention is to provide a propulsion method for a vessel whereby paddles are arranged as such to submerge a paddle while progressing a paddle away from the vessel while alternately lifting the paddle out of the water on its return path back toward the vessel.

Yet another object of the present invention is to provide a propulsion method for a vessel whereby paddles are arranged to create an even complimentary back and forth motion in order to propel a watercraft.

Still yet another object of the present invention is to provide a propulsion method for a vessel whereby paddles are arranged and electrically driven to propel a watercraft Another object of the present invention is to provide a propulsion method for a vessel whereby paddles are arranged onto a platform and unit that is independently constructed to be mounted to a vessel like an outboard motor Yet another object of the present invention is to provide a propulsion method for a vessel whereby a throttle control is provided to control the speed the paddles move at and to control the direction of said displacement is directed.

Still yet another object of the present invention is to provide a propulsion method for a vessel whereby a plurality paddles can ganged or expanded to deliver a propulsion method for a vessel whereby paddles are arranged for more aqueous displacement per stroke.

Additional objects of the present invention will appear as the description proceeds.

The present invention overcomes the shortcomings of the prior art by providing a propulsion method for a vessel whereby it can easily transverse shallow water with a high concentration of grass, Lilly pads, logs and debris with ease utilizing a pair of pivotally and horizontally, transgressing paddles utilizing a system of paddles that are arranged as such to submerge one such pivotally mounted paddle while progressing a paddle away from the vessel while alternately lifting a second partner paddle out of the water on its return path back toward the vessel. Additionally the present invention provides for a means of controlling the speed the device operates, the direction motive force is directed and means for mounting the device to a vessel's stern. Finally the present invention is electrically driven by an electric motor coupled to associated pedal like gearing.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
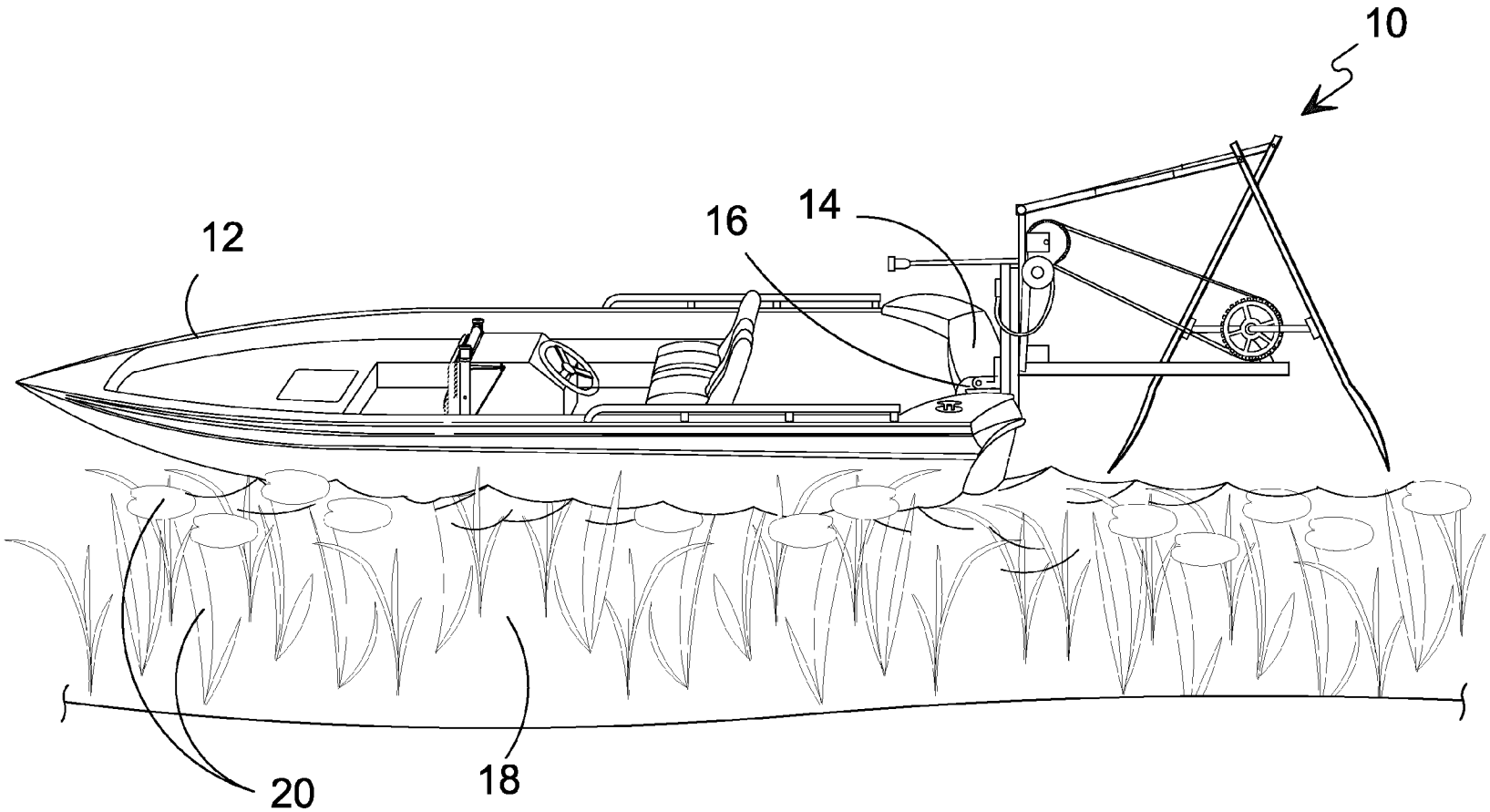
FIG. 1 is an illustrative view of the present invention in use.

Turning now descriptively to the drawings, in which similar reference characters denote similar elements throughout the several views, the Figures illustrate the method of constructing a catalog of the resources accessible through a network of the present invention. With regard to the reference numerals used, the following numbering is used throughout the various drawing figures.

| | |
|---|---|
| 10 | boat motorized paddle propulsion system |
| 12 | boat |
| 14 | motor mount |
| 16 | mount of 10 |
| 18 | water |
| 20 | vegetation/flotsam of 18 |
| 22 | structure of 10 |
| 24 | pivot of 10 |
| 26 | collar of 24 |
| 28 | fastener to 24 |
| 30 | cantilevered support arm |
| 32 | gearing support |
| 34 | bushing |
| 36 | gearing arms |
| 38 | fasteners of 36 |
| 40 | paddle shaft |
| 42 | motor |
| 44 | wiring |
| 46 | power cable |
| 48 | power source |
| 50 | motor gear |
| 52 | drive gear |
| 54 | drive belt |
| 56 | paddle gear |
| 58 | linkage support |
| 60 | linkage pivot |
| 62 | linkage arms |
| 64 | paddle linkage pivot |
| 66 | paddle blade |
| 68 | throttle |
| 70 | directional control |
| 72 | directional control fastener |
| 74 | support |

The present invention relates generally to marine vessels and, more specifically, to a nautical propulsion device comprising a plurality of cooperating paddles driven by levers in a sweeping motion while cooperating with a peddle gear and electric motor in order to produce a reciprocating back and forth paddle motion capable of driving a vessel through water densely populated with obstructive matter such as grass, Lilly pads, logs and other debris with ease. Comprising the paddles main assembly are two pivotally mounted paddles having lever arms attached to the non submerged distal ends of sad paddles so that when a peddle gear is driven a plurality of linkages cooperate to produce the opposed back and forth motion of the operating paddles. Additionally the pedal gear of the present invention allows for the paddles to be lifted while being brought towards the vessel wherethen said paddle is brought downward and away from the vessel to push the device forward. Finally a speed throttle is mounted to the device to control the speed at which the paddles reciprocate and control the directions that force is applied in to the back of a vessel.

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the paddle propulsion apparatus of the present invention in use. The present invention 10 is propulsion apparatus attachable 14, 16 to a watercraft 12 whereby the propulsion system provided by the apparatus is motorized paddle(s) with means for varying the speed of the paddling thereby providing means for moving the watercraft through debris 20 or vegetative 20 waters 18, typically avoided by propeller dive watercraft. The apparatus comprising means for fastening to a watercraft wherein said means includes device comprising releasable fastener, stanchion for fastening motor and gearing element thereto, with the stanchion forming anchor means for linkage extending from the stanchion to the approximate distal end of a paddle pivotally fastened thereto with the stanchion linkage interface also pivotal. Drive mechanism extends from the motor driven stanchion gearing to a paddle gearing fastened to said paddle(s) and anchored to a cantilevered support extending from said stanchion, speed control throttle arm in electrical communication with said motor to enable paddle mode and rate of paddling. While depicted with a finite number of paddles, as depicted in the accompanying drawings and the apparatus location depicted in the rear of the watercraft, various locations and configurations are envisioned to include any number of paddles at any watercraft location including multiple paddle propulsion apparatus at different watercraft location.

Figure 2:
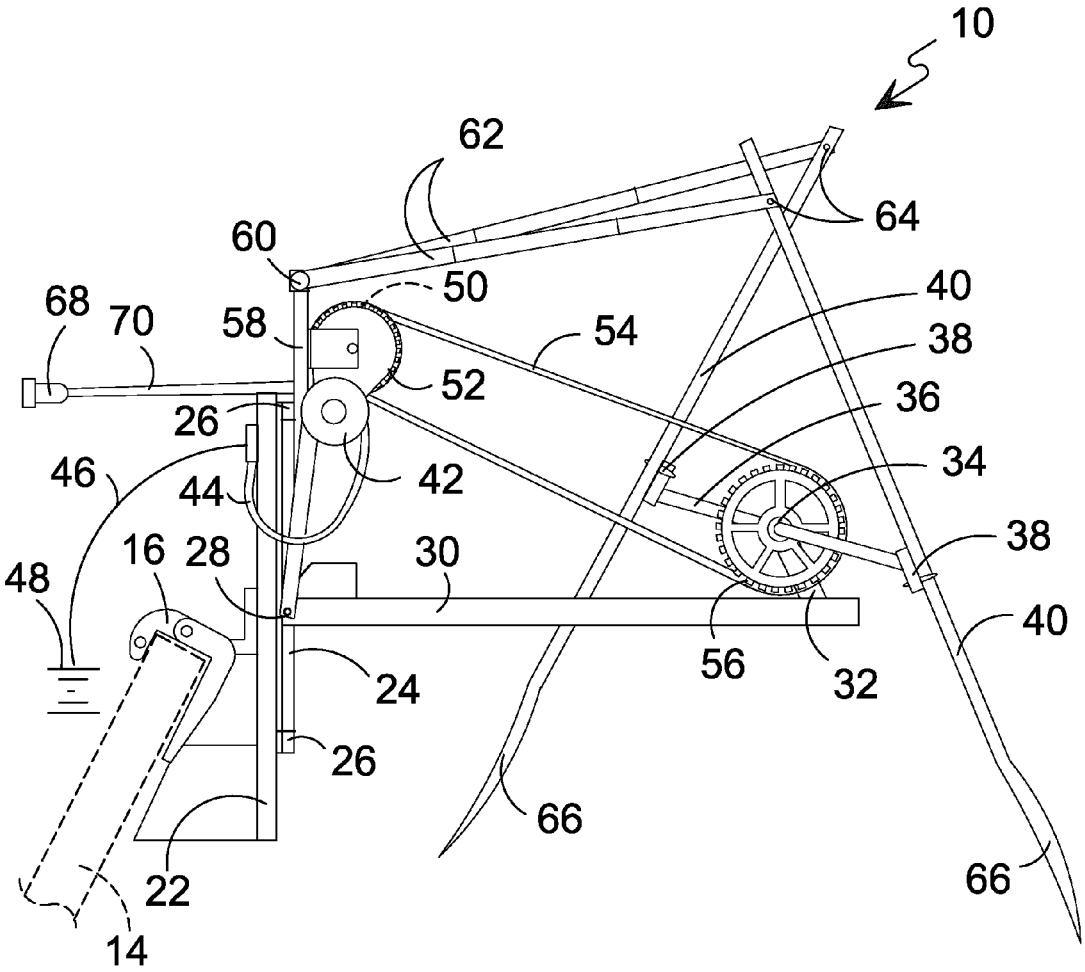
FIG. 2 is a side view of the present invention.

FIG. 2 is a rear view of the present invention. Shown is a rear view of the present invention 10 having a battery powered motor 42 mounted to a transom outboard mounting bracket 14 via attachment 16. The transom mounting bracket has vertical stanchion 22 forming platform for post 24 rotative within collars 26 via directional control 70 having throttle control 68 positioned on the distal end.

In operation, motor 42 in electrical communication 44, 46 with power supply 48, and throttle 68 drive gears 50,52 connected by drive belt 54 to sprocket 56 supported on beam 30 by support 32 whereby gear 34 with arms 36 extending therefrom engage by fastener 38 paddles 40 having blade end 66 with the distal end pivotally fastened to linkage 62 at pivot 60, 64 thereby driving blade end 66 through a water stroke while the other is raised out of the water and returned to a starting water stroke position.

Figure 3:
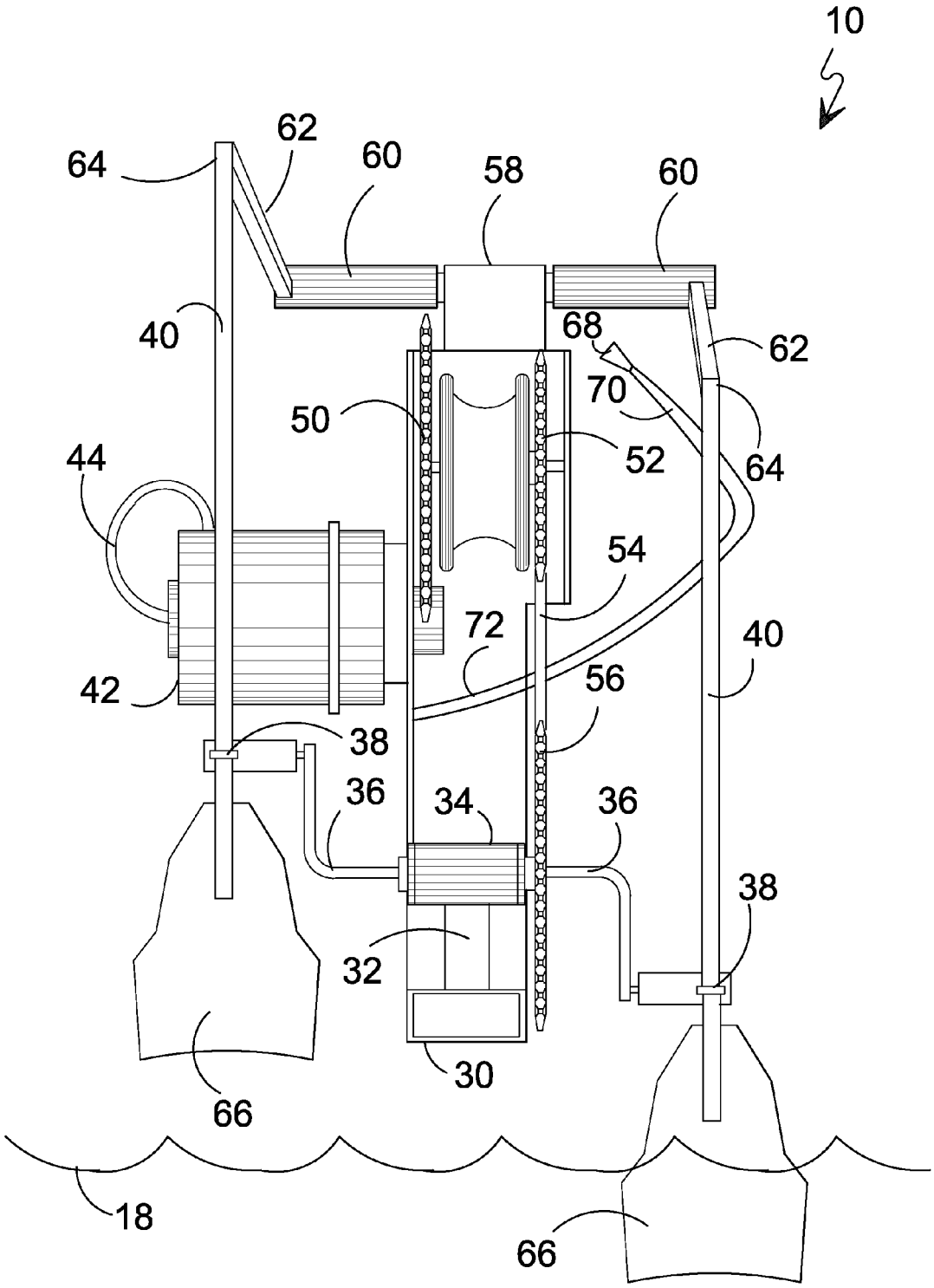
FIG. 3 is a rear view of the present invention.

FIG. 3 is an end view of the present invention. Shown is an end view of the present invention 10 mountable to a transom outboard mounting bracket 14 via attachment 16, shown in FIG. 2. Motor 42 when energized drives sprockets 50, 52 having belt 54 driving sprocket 56 having gear 34 with arms 36 fastened 38 to paddle 40 causing one of the paddle ends 66 to move through a water 18 stroke while the other is moved in an arc over the water to a paddle stroke starting position. the process continues until the motor is de-energized.

Figure 4:
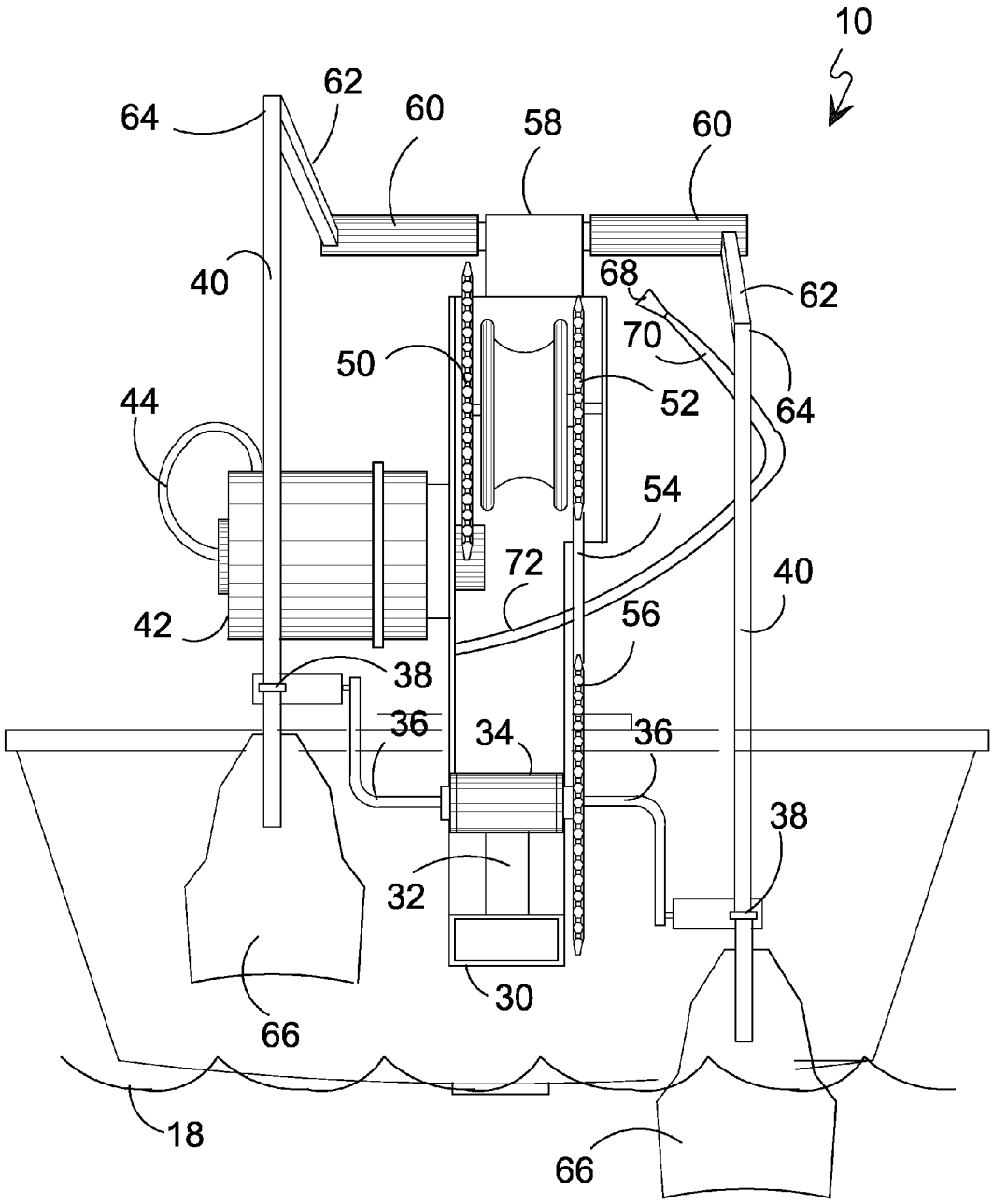
FIG. 4 is a rear view of the present invention mounted to a boat.

FIG. 4 is a rear view of the present invention mounted to a boat. Shown is an end view of the present invention 10 mounted to a transom outboard mounting bracket 14 via attachment 16, shown in FIG. 2. Motor 42 when energized drives sprockets 50, 52 having belt 54 driving sprocket 56 having gear 34 with arms 36 fastened 38 to paddle 40 causing one of the paddle ends 66 to move through a water 18 stroke while the other is moved in an arc over the water to a paddle stroke starting position. the process continues until the motor is de-energized.

Figure 5:
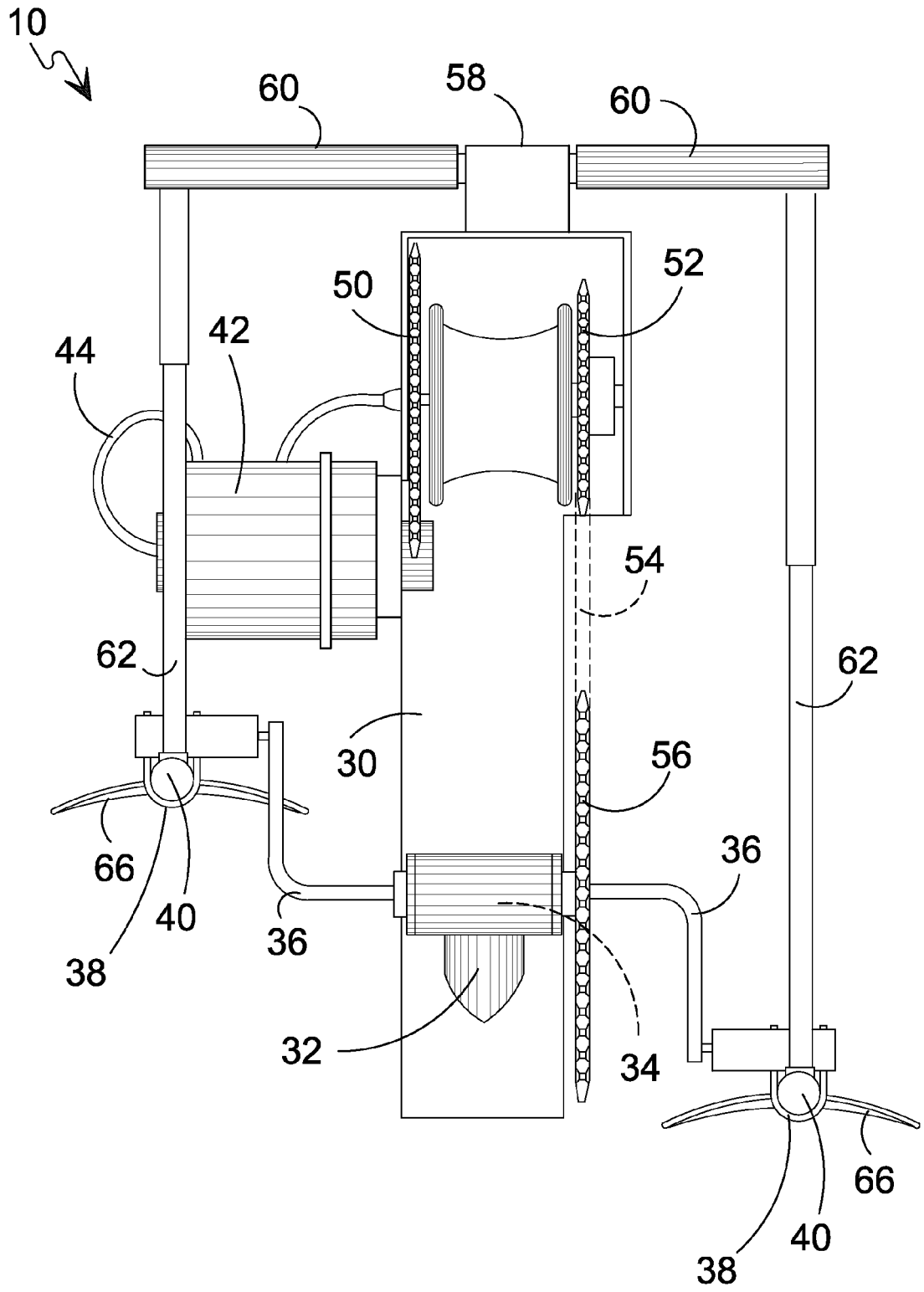
FIG. 5 is a top view of the present invention.

FIG. 5 is a top view of the present invention. Shown is an top view of the present invention 10 having motor 42 when energized drives sprockets 50, 52 having belt 54 driving sprocket 56 having gear 34 with arms 36 fastened 38 to paddle 40 causing one of the paddle ends 66 to move through a water 18 stroke while the other is moved in an arc over the water to a paddle stroke starting position. the process continues until the motor is de-energized.

Figure 6:
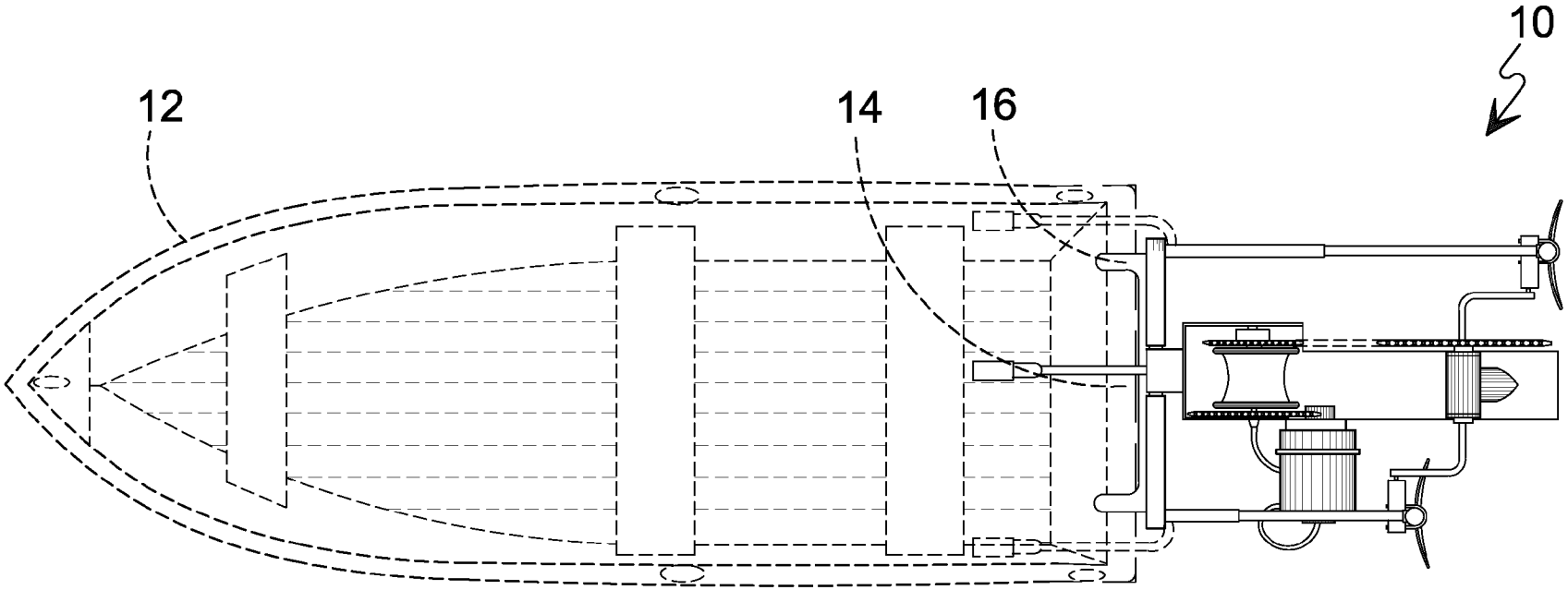
FIG. 6 is a top view of the present invention mounted to a boat's transom.

FIG. 6 is a top view of the present invention mounted to a boat's transom. Shown is a top view of the present invention 10 having a battery powered motor mounted to a boat 12 transom 14 outboard mounting bracket 16. Said transom outboard mounting bracket 16 having a horizontal beam to support a bicycle like crank axle working in conjunction with said motor with crank arms and peddles attaching to boat paddles. Lever arms secured to the upper portion of said paddles are pivotally connected to the motor support plate and assist in stabilizing the paddles. The crankset is chain driven by aid motor at variable speeds controlled by a speed throttle.

Figure 7:
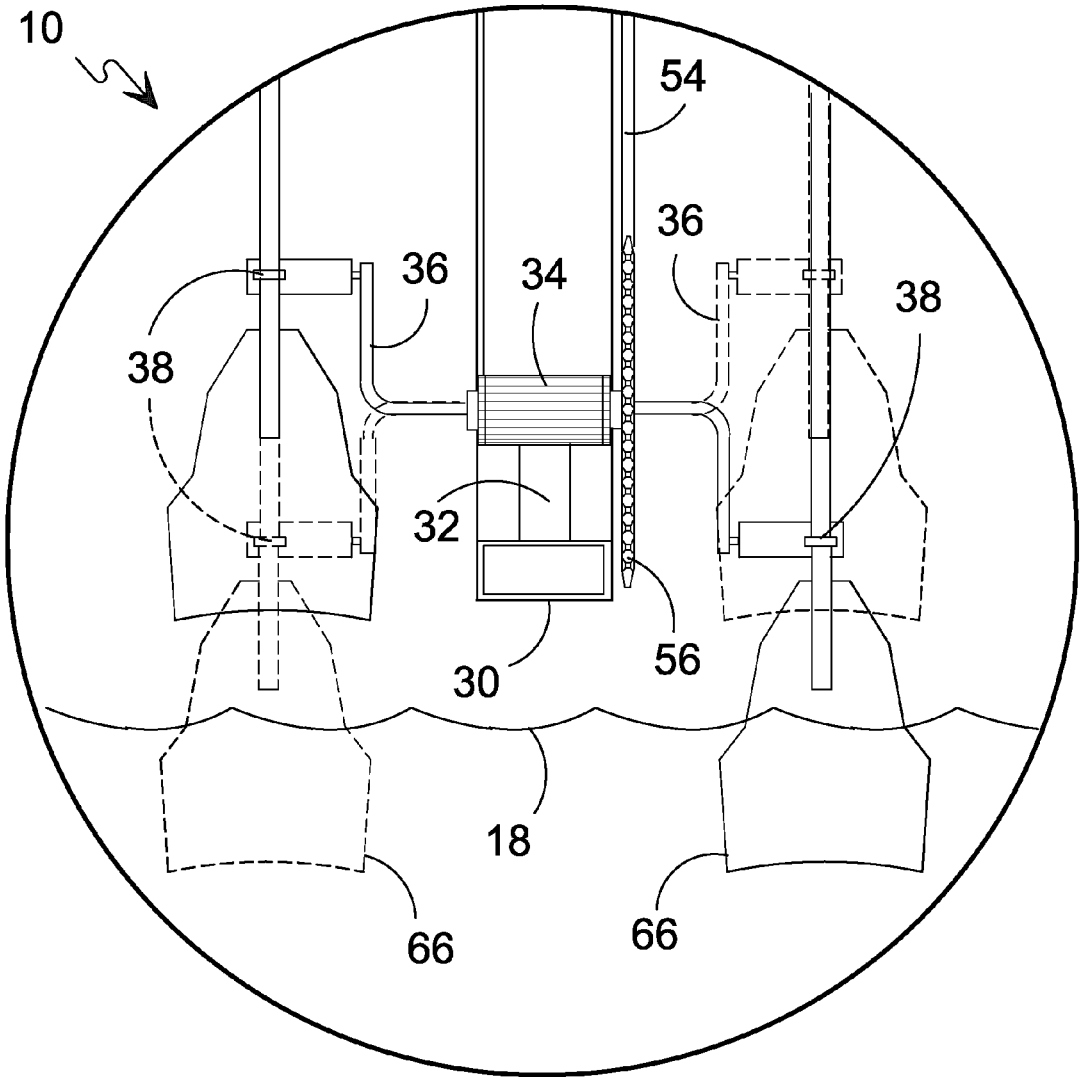
FIG. 7 is a detailed rear view of the present invention.

FIG. 7 is a detailed rear view of the present invention. Shown is a detailed view of the present invention having a horizontal beam 30 to support a bicycle like crank axle 34 working in conjunction with said motor with crank arms 36 and peddles 66 attaching to boat paddles. Lever arms secured to the upper portion of said paddles are pivotally connected to the motor support plate and assist in stabilizing the paddles. The crankset is chain drive 54, 56 by said motor at variable speeds controlled by a speed throttle.

Figure 8:
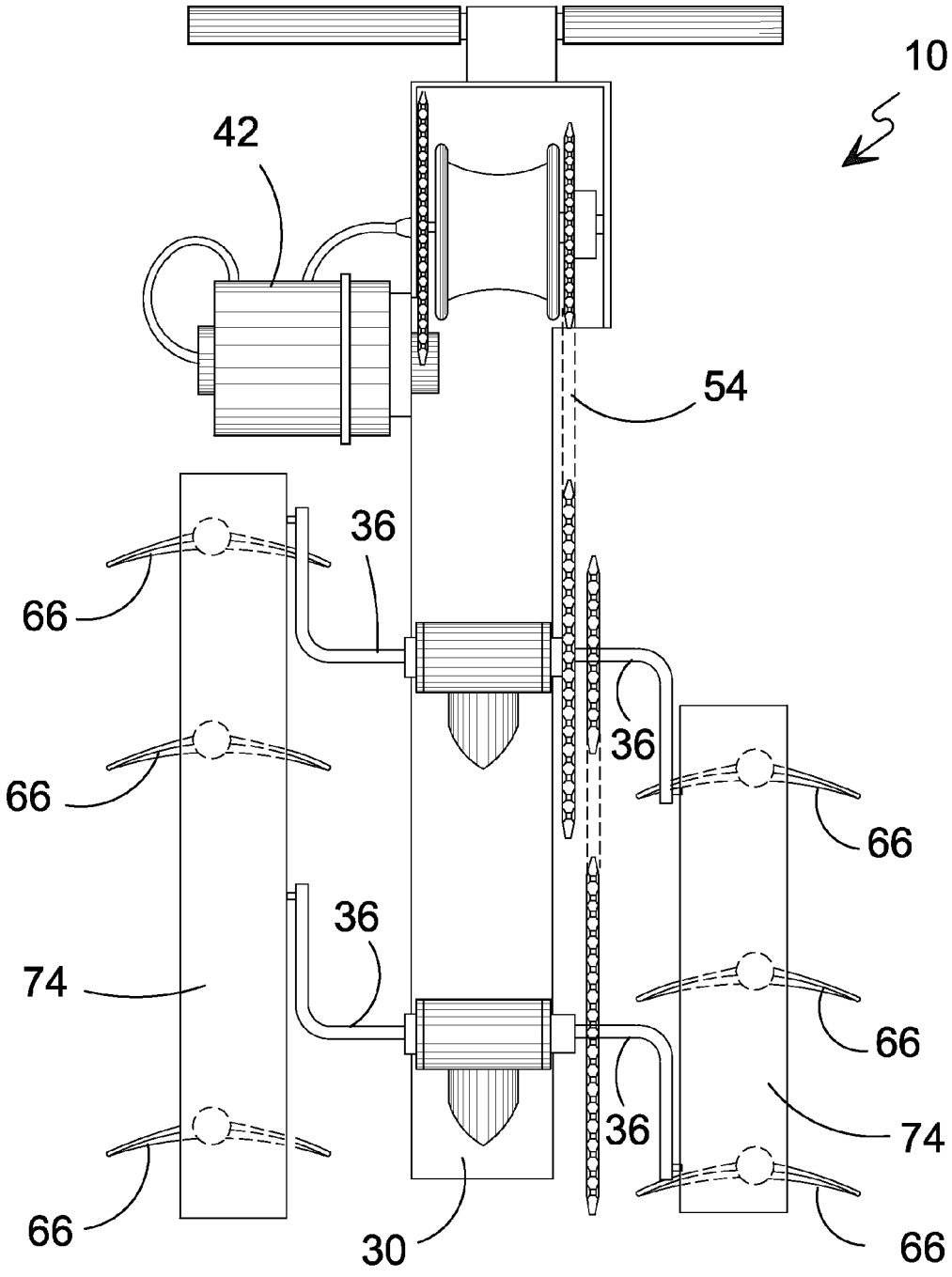
FIG. 8 is an alternate view of the present invention.

FIG. 8 is an alternate view of the present invention. Shown is an alternate view of the present invention having a battery powered motor mounted to a transom outboard mounting bracket. Said transom outboard mounting bracket having a horizontal beam 30 to support two bicycle like crank axles working in conjunction with said motor 42 with crank arms 36 and peddles 66 attaching to two outrigger type beams 74 having three paddles 66 on each beam. The crankset is chain driven by said motor at variable speeds controlled by a speed throttle.

Figure 9:
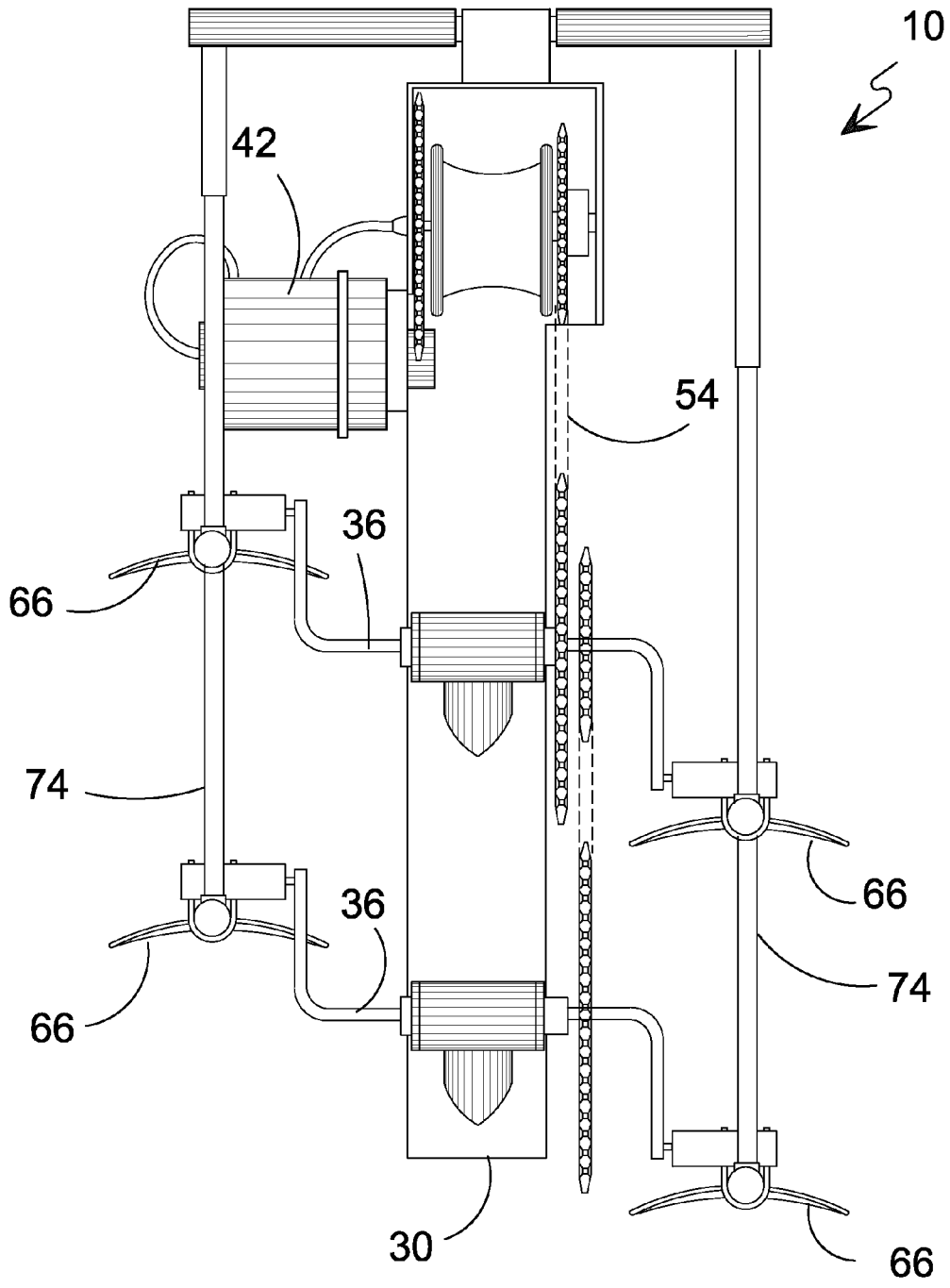
FIG. 9 is an alternate view of the present invention.

FIG. 9 is an alternate view of the present invention. Shown is another alternate view of the present invention having a battery powered motor 42 mounted to a transom outboard mounting bracket. Said transom outboard mounting bracket having a horizontal beam 30 to support two bicycle like crank axles with crank arms 36 and peddles 66 attaching to boat paddles. Lever arms secured to the upper portion of said paddles are pivotally connected to the motor support plate and assist in stabilizing the paddles. The crankset is chain driven by said motor 42 at variable speeds controlled by a speed throttle.

Figure 10:
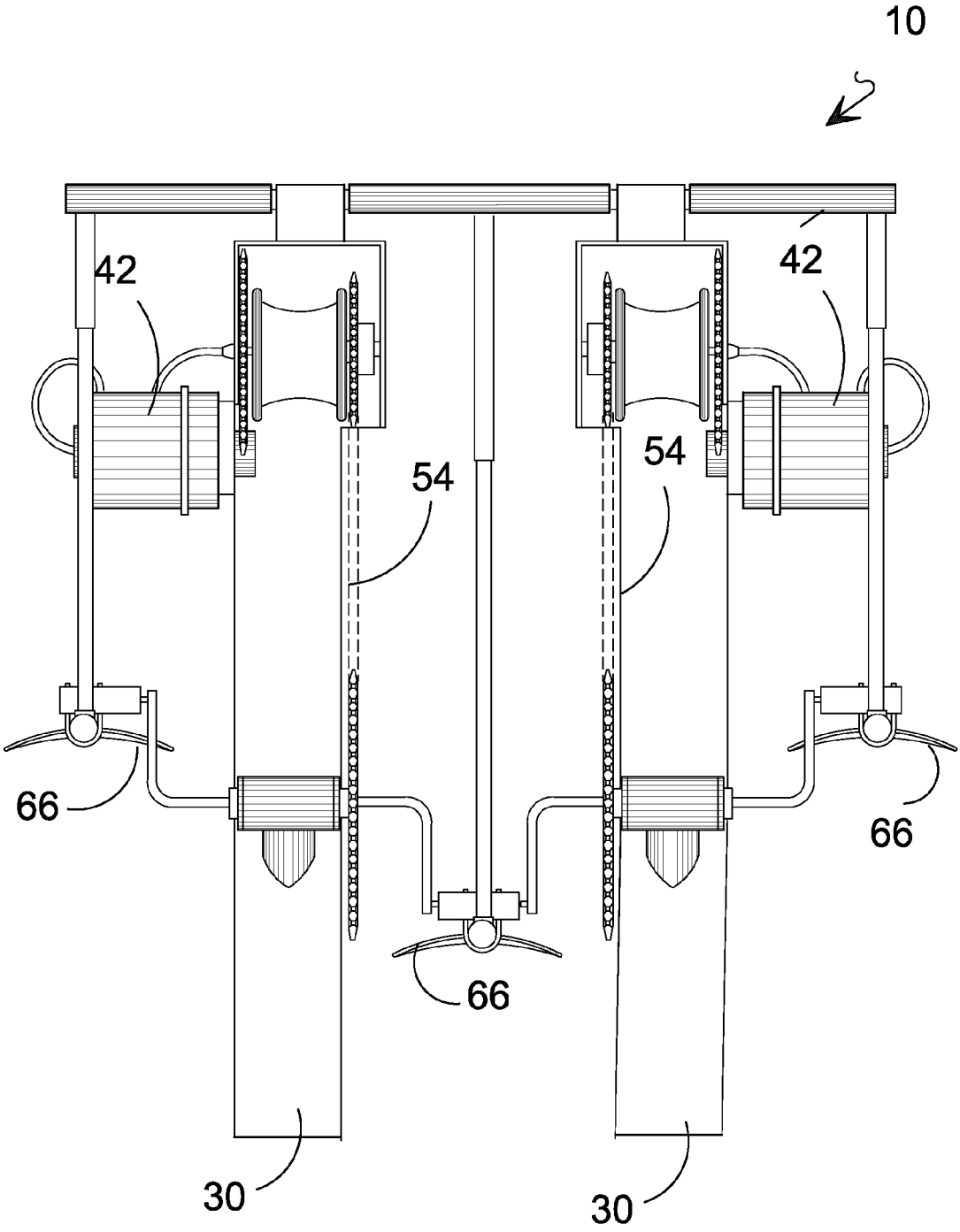
FIG. 10 is an alternate view of the present invention having a battery powered motor mounted to a transom outboard mounting bracket.

FIG. 10 is an alternate view of the present invention having a battery powered motor mounted to a transom outboard mounting bracket. The transom outboard mounting bracket 14 having two horizontal beams 30 to support two bicycle like crank axles with crank arms and peddles 66 attaching to boat paddles. Lever arms secured to the upper portion of said paddles are pivotally connected to the motor support plate and assist in stabilizing the paddles. The crankset is chain driven 54 by said motor at variable speeds controlled by a speed throttle.

Figure 11:
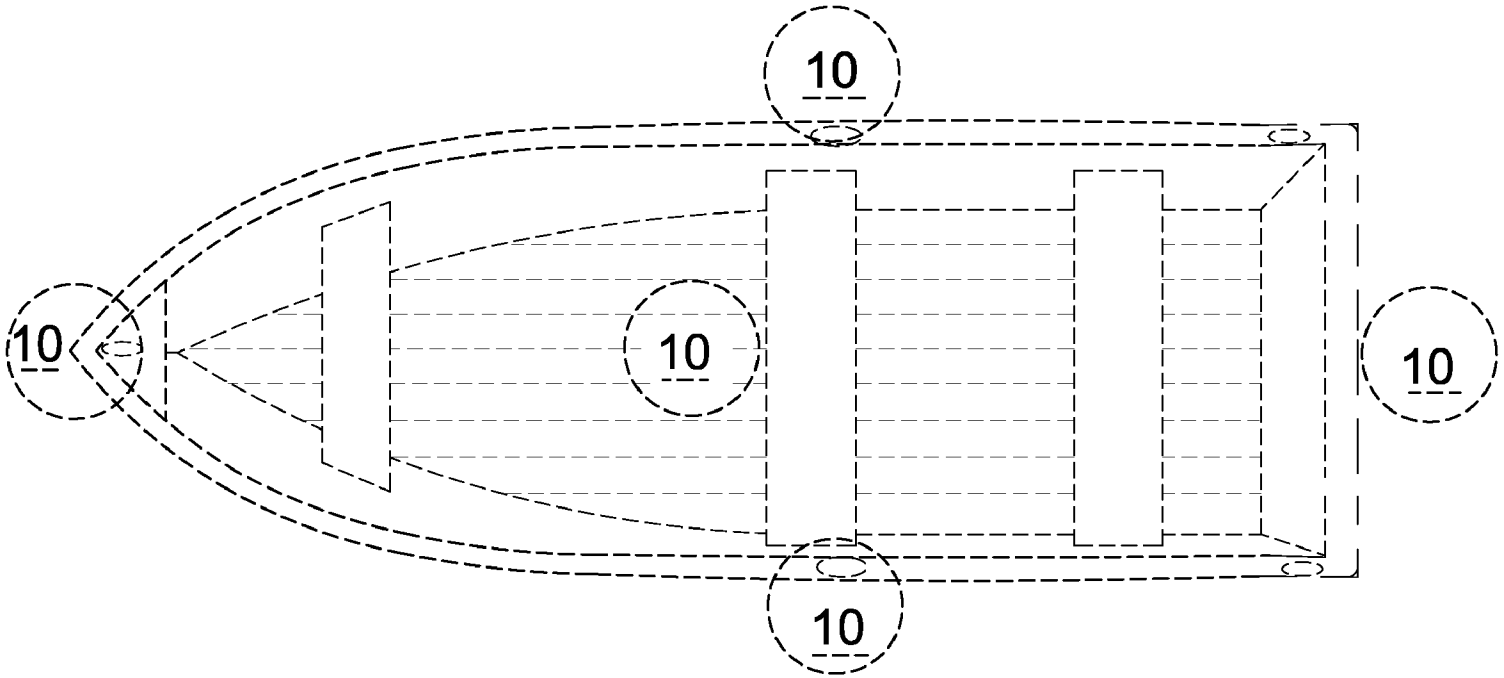
FIG. 11 is a top view of the present invention mounted to various possible positions.

FIG. 11 is a top view of the present invention mounted to various possible positions. Shown is a top view of the present invention 10 having several mounting positions to accommodate the usage of the present invention.

It will be understood that each of the elements described above, or two or more together may also find a useful application in other types of devices differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. An apparatus for propelling a watercraft using motorized paddles, the apparatus comprising:

a) a vertical stanchion having a mount for attaching the apparatus to a transom of the watercraft;

b) a pivot post pivotally attached to said vertical stanchion;

c) a motor secured to the pivot post;

d) the motor in engagement through a drive belt with a pair of paddles;

e) the drive belt connected to a paddle gear with attached gearing arms for driving said pair of paddles;

f) a gearing support for supporting said paddle gear;

g) a motor gear engaging said motor and driven thereby; and h) a cantilevered arm extending from said pivot post and supporting said gearing support.

2. The apparatus of claim 1, further comprising a directional control extending from the pivot post whereby a user can change a direction of the pair of paddles as applied to the watercraft.

3. The apparatus of claim 1, further comprising a throttle in communication with said motor for controlling a speed at which said pair of paddles reciprocate.

4. The apparatus of claim 2, further comprising a pair of linkage arms, wherein each linkage arm is connected to an upper end of one of said pair of paddles.

5. The apparatus of claim 4, further comprising a linkage pivot at the connection of each linkage arm and the paddle to which it is connected.

* * * * *